US006718587B2

(12) United States Patent
Hayes et al.

(10) Patent No.: US 6,718,587 B2
(45) Date of Patent: Apr. 13, 2004

(54) METHOD FOR ESTIMATING AND ADJUSTING TIME REMAINING IN AN APPLIANCE

(75) Inventors: Bobby Hayes, Louisville, KY (US); Mark Weaver, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 153 days.

(21) Appl. No.: 09/681,981

(22) Filed: Jul. 3, 2001

(65) Prior Publication Data

US 2003/0005524 A1 Jan. 9, 2003

(51) Int. Cl.[7] ..... D06F 33/02
(52) U.S. Cl. ..... 8/159; 8/158
(58) Field of Search ..... 8/158, 159; 68/12.01, 68/12.02, 12.05, 12.16

(56) References Cited

U.S. PATENT DOCUMENTS

| | | | | |
|---|---|---|---|---|
| 4,224,530 A | | 9/1980 | Simcoe et al. | 307/141 |
| 4,318,084 A | | 3/1982 | Scott et al. | 340/309.8 |
| 4,763,493 A | | 8/1988 | Nishite et al. | 68/12.27 |
| 5,285,545 A | | 2/1994 | Payne et al. | 8/158 |
| 5,560,060 A | * | 10/1996 | Dausch et al. | 8/158 |
| 5,570,596 A | | 11/1996 | Imai et al. | 68/12.05 |
| 5,634,227 A | | 6/1997 | Lim | 8/158 |

* cited by examiner

*Primary Examiner*—Randy Gulakowski
*Assistant Examiner*—Joseph Perrin
(74) *Attorney, Agent, or Firm*—George L. Rideout, Jr. Esq.; Armstrong Teasdale LLP

(57) ABSTRACT

A method is provided for estimating the time required to perform an operational cycle of an appliance, the cycle including at least one variable operational mode. The method includes providing a memory for storing historical data of previously executed cycles of the appliance, accessing the memory in light of a user-selected option for a present cycle, and computing an initial estimated time for performing the present cycle of the appliance based, at least in part, on a time estimate for the at least one operational mode. The method continues with determining an actual time used for performing at least one occurrence of the operational mode, relating the actual time used to the time estimate used for computing the initial estimated time for performing the present cycle of the appliance, and adjusting the initial estimated time for performing the present cycle in light of any differences between the actual and estimated times for the at least one operational mode.

30 Claims, 2 Drawing Sheets

METHOD FOR ESTIMATING AND ADJUSTING TIME REMAINING IN AN APPLIANCE

BACKGROUND OF INVENTION

The present invention relates generally to electronic appliance controllers, and, more particularly, to appliance control techniques that tend to provide an accurate "Time Remaining" display, notwithstanding of variations in the actual time required for performing various operational modes of the appliance, such as water fill and/or drain in a washing machine.

A desirable feature in many automated appliances, such as clothes washing machines, driers, dish washers, is to provide a "Time Remaining" display which indicates cycle time remaining based on the state of a count down timer maintained by the controller. In a typical commercial, coin-operated laundry environment, a dryer cycle may be entirely time driven, so little difficulty is involved in maintaining an accurate "Time Remaining" display. The controller simply initializes the count down timer with the total cycle time, and then decrements the count down timer at regular predetermined intervals.

However, a clothes washer is both time and event driven, such that an accurate measure of cycle time remaining is more difficult to achieve. Thus, in the case of a washing machine, in order to initialize the count down timer, the control system would sum the time requirements of the various portions of the cycle, referred to herein as operational modes. By way of example, the time requirements of a full cycle may include wash water fill time, soak time, wash agitate time, wash water drain time, spin time, rinse fill time, rinse agitate time, rinse water drain time, final spin time, and pauses that may occur between some of these operational modes. The pauses may be required in certain situations in order to allow the machine to come to a complete stop upon completion of one operational mode and the commencement of another operational mode. For example, a washing machine would likely be damaged if an attempt were made to switch instantaneously from agitate mode to spin, assuming a change in motor direction is involved.

The operational mode times just mentioned are under the direct control of the controller, with the exception of fill and drain times. In particular, both the cessation of water fill and water drain are event driven rather than time driven. For example, fill time may be based on the closing of a water level sensor switch. Similarly, drain time may be based on sensing changes in the level of motor current. Thus, the actual time required to fill or drain the machine varies depending on the amount of time it takes the appliance to reach a desired condition and is known only after the water fill or drain has occurred. This prevents an accurate initializing of the count down timer and thus prevents an accurate display of time remaining in the wash cycle.

In the past, this problem has been addressed by simply stopping the timer during water filling or draining operations. However, when such an approach is employed, the displayed "Time Remaining" has little practical use since the operational cycle is not complete after the number of displayed minutes.

Another approach used in the context of an electronically-controlled washing machine is described in U.S. Pat. No. 5,285,545 commonly assigned and herein incorporated be reference. The invention disclosed in that patent recognizes that it is possible to adjust the length of time of the pause intervals to somewhat compensate for actual fill times which differ from the nominal fill time.

Yet another approach would be to maintain a history of each particular machine to learn the actual fill times for that particular machine. This may be accomplished using a data filtering technique whereby a running average is kept for the fill times, and running average data is used in a calculation for determining nominal fill times. Unfortunately, this approach would offer improved accuracy in estimating cycle time and thus in accurately displaying "Time Remaining", only if the user operated the machine essentially under the same cycle options corresponding to the nominal times. For example, routinely washing the same level of load at the same temperature settings. This drawback arises since the nominal times could be very different from the actual times required for the different user-selectable cycle options, such as temperature settings, water level setting, etc.

Accordingly, it would be desirable to provide an appliance control system including a "Time Remaining" display, which is accurate notwithstanding variations in the actual time required for water filling and draining operations, and which takes into account of the specific cycle option selected by the user. It will be further desired to provide techniques that allow to decrement the time remaining display without sudden jumps or discontinuities by adjusting the duration of the time intervals at which a sequence of equally-sized decrementing steps are triggered.

SUMMARY OF INVENTION

Generally, the present invention fulfills the foregoing needs by providing in one aspect thereof, a method for estimating the time required to perform an operational cycle of an appliance. The cycle includes at least one operational mode whose individual duration varies depending on the time it takes the appliance to reach a desired condition. The method allows to provide memory for storing historical data of previously executed cycles of the appliance. The historical data comprises at least one appliance parameter for the at least one operational mode for each cycle option of the appliance. The method further allows to access the memory in light of a user-selected option for a present cycle. A computing action allows to compute an initial estimated time for performing the present cycle of the appliance based, at least in part, on a time estimate for the at least one operational mode. The time estimate is based on the historical appliance parameter for the at least one operational mode. The time estimate may be adjusted to correspond to the selected option for the present cycle. An actual-time determining action allows to determine the actual time used for performing at least one occurrence of the operational mode during the present cycle. A relating action allows to relate the actual time used for performing the at least one occurrence of the operational mode during the present cycle relative to the time estimate used for computing the initial estimated time for performing the present cycle of the appliance. An adjusting action allow to adjust the estimated time for performing the present cycle of the appliance in light of any differences between the actual and estimated times for the at least one operational mode.

The present invention further fulfills the foregoing needs by providing in another aspect thereof, a system for estimating the time required to perform an operational cycle of an appliance. The cycle including at least one operational mode whose individual duration varies depending on the time it takes the appliance to reach a desired condition. The system includes memory for storing historical data of previously executed cycles of the appliance. The historical data comprises at least one appliance parameter for the at least one operational mode of the appliance. A processor is coupled to the memory to access historical data therein in light of a user-selected option for a present cycle. The processor is configured to compute an initial estimated time for performing the present cycle of the appliance based, at least in part, on a time estimate for the at least one operational mode. The time estimate is based on a running average of the historical data for the at least one operational mode. A determining module is configured to determine the actual time used for performing at least one occurrence of the operational mode during the present cycle. A comparator is configured to relate the actual time used for performing the at least one occurrence of the operational mode during the present cycle relative to the time estimate used for computing the initial estimated time for performing the present cycle of the appliance. A cycle time adjuster is configured to adjust the estimated time for performing the present cycle of the appliance in light of any differences between the actual and estimated times for the at least one operational mode.

In yet another aspect thereof, the present invention provides a "time-remaining" processor for an appliance. The processor includes a first register for storing an estimated value of "time-remaining" for completing a present cycle as the appliance progresses through the cycle. The "time-remaining" processor includes a second register for storing a presently displayed value of "time-remaining" and is configured to perform the following actions:

decrementing the displayed value of "time-remaining" by a sequence of steps of equal size from an initial estimate of "time-remaining" based on an initial estimate for performing the present cycle;

updating the initial estimate of "time-remaining" in light of any adjustments made to the initial estimated time for performing the cycle;

storing the updated estimate of "time-remaining" in the first register;

in the event the value of the updated estimate of "time-remaining", as stored in the first register, substantially corresponds to the value of "time-remaining" being presently displayed as stored in the second register, the sequence of equal size steps for decrementing the displayed value as stored in the second register is triggered at time intervals corresponding to the size of each decrementing step; and in the event the value of the updated estimate of "time-remaining" as stored in the first register, deviates from the value of "time-remaining" being displayed as stored in the second register, the sequence of equal size steps for decrementing the displayed value as stored in the second register, is triggered at time intervals that vary relative to the size of each decrementing step, the time interval variation based on a functional relationship between the value of the updated estimate "time-remaining" and the displayed value for "time-remaining" and wherein the functional relationship is based on the ratio of the value of the updated estimate of "time-remaining" as stored in the first register over the displayed value for "time-remaining", as stored in the second register.

BRIEF DESCRIPTION OF DRAWINGS

The features and advantages of the present invention will become apparent from the following detailed description of the invention when read with the accompanying drawings in which.

DETAILED DESCRIPTION

Figure 1:
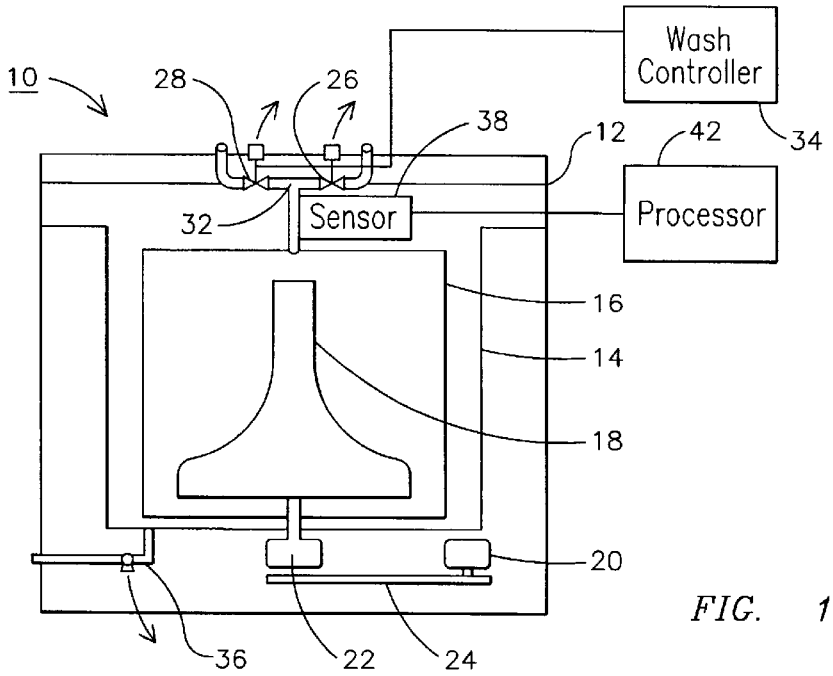
FIG. 1 is a schematic representation of an exemplary clothes washer appliance that may benefit from the teachings of the present invention.

FIG. 1 illustrates an exemplary appliance that may benefit from the teachings of the present invention. Although the invention below is described in the context of a washing machine, it will be appreciated that the concepts of the present invention can be applied to many types of appliances, such as driers, dishwashers, computers, etc. The present invention in one aspect thereof provides a system for estimating the time required to perform an operational cycle of the appliance. The cycle includes at least one operational mode, e.g., fill and drain operational modes, whose individual duration varies depending on the time it takes the appliance to reach a desired condition.

As shown in FIG. 1, the washing machine 10 includes an outer housing 12, and an inner tub 14, and basket 16. Typically, basket 16 is perforated to allow for the passage of water. During operation, water within the tub is churned by an agitator 18. A motor 20, transmission 22, and pulley 24 are included for imparting rotary motion to the agitator 18 and basket 16. Two valves govern the flow of water into the washing machine; one for hot water, the other for cold (26 and 28 respectively). A mixing chamber 32 is employed to combine the hot and cold water prior to the water being dispensed into the tub 14. The temperature of water leaving the mixing chamber 32 as sensed by a temperature sensor 38 can be regulated by controlling the flow rates from the hot and cold valves respectively. Such temperature regulation is achieved by way of a wash controller 34. A drainage pump 36 is provided for draining water at the completion of predefined operations of the appliance.

As is customarily done by users, prior to initiating a cycle of operation, the user selects cycle options, such as the water levels and temperatures, appropriate to the amount and type of laundry to be cleaned. On the basis of the selected option, the washing machine 10 begins to fill wash basket 16 with a predetermined amount of water at a predetermined temperature. After the washing machine 10 is filled, the cycle may continue in accordance with a pre-programmed sequence of operations corresponding to the cycle option selected by the user. It will be appreciated that the duration of the cycle may be influenced by a variety of factors. For example, the cycle option selected by the user may require two or more fill operations at different temperatures, and this may result in different fill times for each fill operation. The user sometimes may intentionally change the cycle option. For example, the user may have initially selected a light load option, and with the cycle underway may change to a delicate load option. To complicate matters even more, there are environmental factors or other variable operational conditions, such as water pressure, drain hose positioning, that may affect the fill and drain times. Thus, any initial computation of cycle time estimate and associated time-remaining may require adjustments as the cycle progresses. The system of the present invention allows to provide such adjustments and display time-remaining information in a manner that closely mimics the actual operational conditions of the present cycle without sudden jumps.

The processor 42 is electrically coupled to receive signal indications that allow to determine the actual fill and drain times as the machine progresses through a given cycle. As suggested above, the signal indications may be supplied by a standard water level sensor or may comprise motor current from a current sensor. These time values can be stored in a memory 44 configured to store historical data of previously executed cycles of the appliance. The historical data may comprise the actual times used for performing the at least one operational mode, or estimates of other parameters derived from the actual times, such as flow rates or water pressures, that may be equally useful to determine the duration of a fill operation. Processor 42 may be used to derive water pressure, and flow rate. These parameters or times may be specific to one or more cycle options of the machine or representative of all cycle options or of the operating environment of the machine, such as flow rates, pressures, voltages, etc. The memory may take the form of a list, a look up table or a single historical value, such as an exponentially weighted moving average of past cycles.

The processor 42 includes a computing module 46 configured to compute an initial estimated time for performing the present cycle of the appliance based, at least in part, on a time estimate for the at least one operational mode. The time estimate is based on a running average of the historical data for the at least one operational mode, either for all cycle options or for particular selected options for the present cycle. It will be understood that the techniques of the present invention do not require keeping data for a particular selected option since a single water flow rate, for example, may be used as representative of all cycle options. In fact, in one exemplary embodiment, one keeps track of a single flow rate at a given temperature setting, and one can then calculate the flow rate at other temperature settings. That is, one need not monitor a different flow rate for each cycle option. For example, if the temperature of a particular fill operation is cold, one can take the volume of water used (known because the pressure switch trips at a fixed level) and divide that volume by the time-to-fill to determine the cold flow rate, then one could multiply that result by an appropriate mixing ratio, e.g., 1.0/0.6, to get an equivalent flow rate in warm. Similarly, if the user selects hot for a later cycle, the flow rate in hot may be estimated by using the appropriate mixing ratio, e.g., 0.4/1.0, times the exponentially weighted moving average of the historical warm equivalent flow rates. It has been found that a mix ratio of about 60/40 for the water valves is nearly constant over a wide range of pressures, and since in most homes the hot and cold water is essentially at the same pressure, using such mix ratio works fairly well for adjusting flow rate as a function of temperature setting. That is, the foregoing mix ratio assumes the flow rate for cold is 60% of the flow rate for warm. Similarly, the flow rate for hot water is assumed as 40% of the flow rate for warm water. It will be understood that the techniques of the present invention are not limited to any specific mix ratio since such ratio could be varied depending on the requirements of any given application.

In one exemplary embodiment, module 46 performs an exponentially weighted moving average for calculating or estimating the time estimate for the operational mode corresponding to the selected option for the present cycle. In this exemplary embodiment, a fill time estimate for the present cycle would be equal to: $(1-\lambda)$*previous fill time estimate+$(\lambda)$*(most recent fill time), wherein $\lambda$ is a predefined time weighing or moving average constant.

Similarly, a drain time estimate for the present cycle would be equal to: $(1-\lambda)$*previous drain time estimate+$(\lambda)$*(most recent drain time), wherein $\lambda$ is a predefined time weighing or moving average constant.

It will be appreciated by those skilled in the art that an exponentially weighted moving average is only one example of a technique for processing the historical data for estimating the initial cycle time, since other time averaging techniques could be used in lieu of an exponentially weighted moving average. A typical value for constant $\lambda$ is 0.3. The above-described technique ensures that random variations that may occur from one cycle to the next do not have a significant effect on the estimation of the initial cycle time and that only statistically consistent usage and environmental influences would cause significant variation on the initial cycle time estimation. Further, it will be appreciated that the above-described technique for processing historical data requires relatively little storage being that such computation uses summary statistics in lieu of processing every single data point of each previous fill or drain time of previously executed cycles.

A determining module 48 is provided to determine the actual time used for performing at least one occurrence of the operational mode during the present cycle. For example, module 48 may use a timer to determine elapsed time from start of a filling operation to the completion of the filling operation, as sensed by a water level sensor.

A comparator 50 is provided to relate the actual time used for performing the at least one occurrence of the operational mode during the present cycle relative to the time estimate used for computing the initial estimated time for performing the present cycle of the appliance. A cycle time adjuster 52 is provided to adjust the estimated time for performing the present cycle of the appliance in light of any differences between the actual and estimated times for the at least one operational mode.

For example, assuming the estimated value for a fill operation based on the historical data corresponding to the selected cycle option indicates a fill time of 3 minutes, and the actual fill time as measured in the present cycle for that cycle option indicates an actual fill time of 2.5 minutes. Further assuming that the estimated value for a drain operation based on the historical data corresponding to the selected cycle option indicates a drain time of 3 minutes, and the actual drain time as measured in the present cycle for that cycle option indicates an actual drain time of 2 minutes. In the event, the selected cycle option, respectively requires a total of two fill and drain operations. Then, the estimated cycle duration (exclusive of any other time-driven operational modes) based on the historical data would be 12 minutes while the cycle duration based on the actual times would be 9 minutes. Thus, in this case, the initial "time-remaining" based on the historical data would have been 12 minutes. In fact, the actual time for the present cycle is expected to last 9 minutes. Thus, an issue is presented as to how convey the updated time-remaining information to an observer while creating in the mind of the observer a feeling of trustworthiness regarding the quality of any displayed information.

Figure 2:
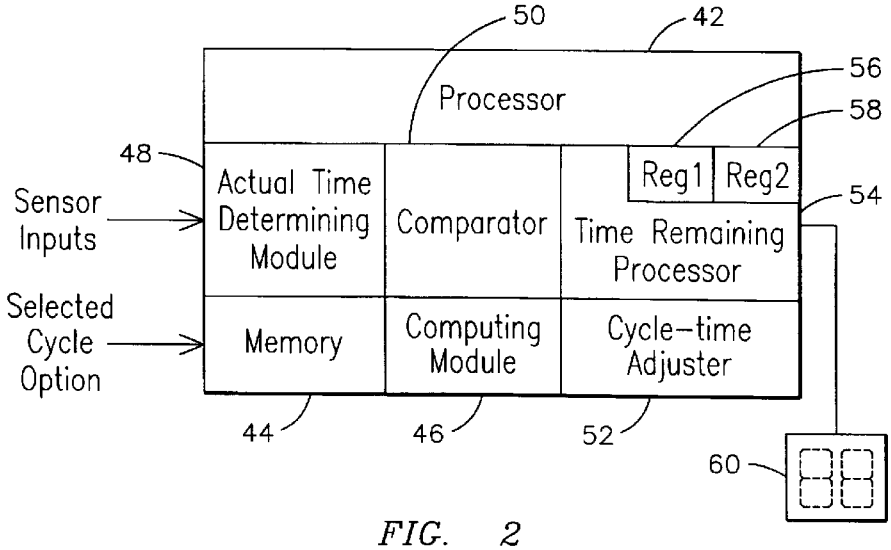
FIG. 2 includes details regarding a processor used by the appliance of FIG. 1 in accordance with aspects of the present invention.

FIG. 2 further illustrates a "time-remaining" processor 54 including a first register 56 for storing an estimated value of "time-remaining" for completing a present cycle as the appliance progresses through the cycle. The "time-remaining" processor 42 further includes a second register 58 for storing a presently displayed value of "time-remaining" as may displayed in a display device 60. In the foregoing example, second register 58 would include a value of 12 minutes while the first register would include a value of 9 minutes. The time remaining processor 54 may be configured to perform an algorithm 100, as illustrated in FIG. 3.

Figure 3:
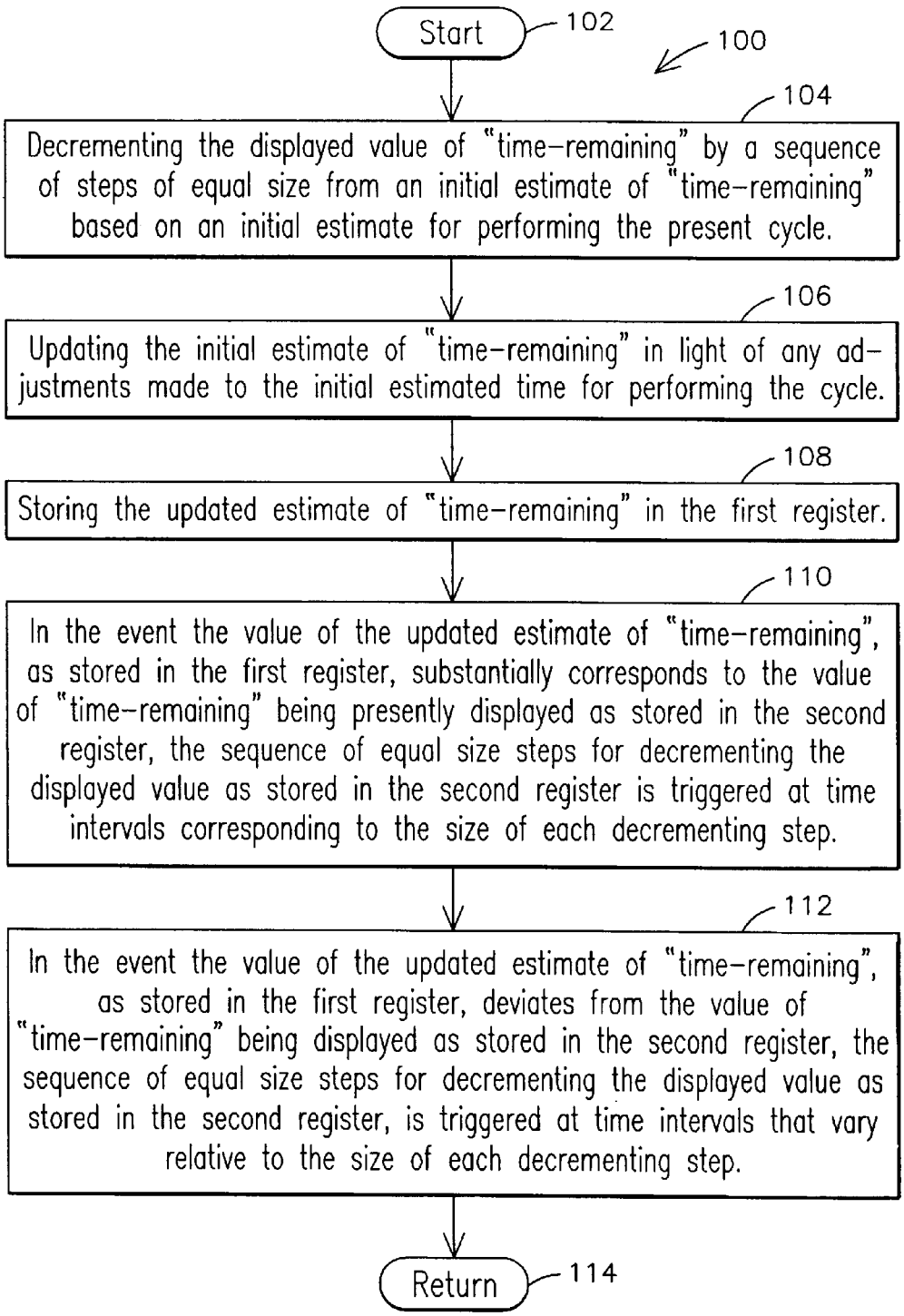
FIG. 3 is a flow chart of an algorithm that may be performed by the processor of FIG. 2 to estimate a "Time Remaining" for completing an operational cycle of the appliance.

As shown in FIG. 3, subsequent to a start action 102, block 104 allows to decrement the displayed value of "time-remaining" by a sequence of steps of equal size from an initial estimate of "time-remaining" based on the initial estimate for performing the present cycle. In one exemplary embodiment the size of the decrementing step corresponds to one minute. Block 106 allows to update the initial estimate of "time-remaining" in light of any adjustments made to the initial estimated time for performing the cycle. In the foregoing illustration, the initial estimate of "time-remaining" of 12 minutes would be updated to 9 minutes. Block 108 allows to store the updated estimate of "time-remaining" in the first register 56 (FIG. 2). Thus, in this example, first register would include a value of 9 minutes.

As shown in block 110, in the event the value of the updated estimate of "time-remaining", as stored in the first register, substantially corresponds to the value of "time-remaining" being presently displayed, as stored in the second register 58 (FIG. 2), the sequence of equal size steps for decrementing the displayed value, as stored in the second register, is triggered at time intervals corresponding to the size of each decrementing step. In the foregoing example, this logical condition would have applied in the event that the updated estimate of "time-remaining" would have corresponded to the displayed "time-remaining". That is, if the displayed "time-remaining" and the updated estimate of "time-remaining" would have been the same, e.g., 12 minutes, then there would be 12 decrements of equal size triggered at a rate of one per minute.

As shown in block 112, in the event the value of the updated estimate of "time-remaining" as stored in the first register, deviates from the value of "time-remaining" being displayed, as stored in the second register, the sequence of equal size steps for decrementing the displayed value as stored in the second register, is triggered at time intervals that vary relative to the size of each decrementing step. In particular, the time interval variation is based on a functional relationship between the value of the updated estimate "time-remaining" and the displayed value for "time-remaining". In one exemplary embodiment, the functional relationship is based on the ratio of the value of the updated estimate of "time-remaining", as stored in the first register, over the displayed value for "time-remaining", as stored in the second register. In this example, the ratio is 9/12=0.75. Thus, in this case, every decrement having an equal size of one minute would occur every ¾ of a minute, as opposed to every minute. This technique allows for a visually smoother visual and ensures that a zero indication in the time-remaining display will coincide with the actual end of the cycle.

Conversely, assuming the displayed value was 12 minutes and the updated time-remaining estimate was 9 minutes, the ratio would be equal 12/9=1.25. Thus, in this case, every decrement having an equal size of one minute would occur every 1¼ of a minute, as opposed to every minute.

The present invention can be embodied in the form of computer-implemented processes and apparatus for practicing those processes. The present invention can also be embodied in the form of computer program code containing computer-readable instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose computer, the computer program code segments configure the computer to create specific logic circuits or processing modules.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for estimating the time required to perform an operational cycle of an appliance, the cycle including at least one operational mode whose individual duration varies depending on the time it takes the appliance to reach a desired condition, the method comprising:

providing memory for storing historical data of previously executed cycles of the appliance, the historical data comprising at least one appliance parameter for the at least one operational mode of the appliance;

accessing the memory in light of a user-selected option for a present cycle;

computing an initial estimated time for performing the present cycle of the appliance based, at least in part, on a time estimate for the at least one operational mode, the time estimate based on the at least one historical appliance parameter for the at least one operational mode;

determining the actual time used for performing at least one occurrence of the operational mode during the present cycle;

relating the actual time used for performing the at least one occurrence of the operational mode during the present cycle relative to the time estimate used for computing the initial estimated time for performing the present cycle of the appliance; and adjusting the initial estimated time for performing the present cycle of the appliance in light of any differences between the actual and estimated times for the at least one operational mode.

2. The method of claim 1 wherein the appliance comprises a washing machine and the at least one operational mode is selected from the group comprising fill and drain modes of the washing machine.

3. The method of claim 2 wherein the at least one appliance parameter is selected from the group consisting of actual completion times, estimates of flow rate, and estimates of water pressure.

4. The method of claim 1 wherein the computing of the time estimate for the at least one operational mode comprises computing a running average on the historical data corresponding to the selected option for the present cycle.

5. The method of claim 4 wherein the running average comprises an exponentially weighted moving average.

6. The method of claim 1 further comprising displaying an estimated value of "time-remaining" for completing the present cycle as the appliance progresses through the cycle, the displayed value of "time-remaining" being decremented by a sequence of steps of equal size from an initial estimate of "time-remaining" based on the initial estimate for performing the present cycle.

7. The method of claim 6 further comprising updating the initial estimate of "time-remaining" in light of any adjustments made to the initial estimated time for performing the cycle.

8. The method of claim 7 wherein in the event the value of the updated estimate of "time-remaining" deviates from the value of "time-remaining" being displayed, the sequence of equal size steps for decrementing the displayed value is triggered at time intervals that vary relative to the size of each decrementing step, the time interval variation based on a functional relationship between the value of the updated estimate of and the "time-remaining" displayed value for "time-remaining".

9. The method of claim 8 wherein the functional relationship is based on the ratio of the value of the updated estimate of "time-remaining" over the displayed value for "time-remaining".

10. The method of claim 9 further comprising adjusting the estimate of "time-remaining" in light of any changes made by the user to any previously selected option for the present cycle.

11. The method of claim 6 wherein in the event the value of the updated estimate of "time-remaining" substantially corresponds to the value of "time-remaining" being displayed, the sequence of equal size steps for decrementing the displayed value is triggered at time intervals corresponding to the size of each decrementing step.

12. A method for estimating the time required to perform an operational cycle of an appliance, the cycle including at least one operational mode whose individual duration varies depending on the time it takes the appliance to reach a desired condition, the method comprising:

providing memory for storing historical data of previously executed cycles of the appliance, the historical data comprising at least one appliance parameter corresponding to the at least one operational mode of the appliance;

accessing the memory in light of a user-selected option for a present cycle;

computing an initial estimated time for performing the present cycle of the appliance based, at least in part, on a time estimate for the at least one operational mode, the time estimate based on the at least one historical appliance parameter for the at least one operational mode of the appliance; and updating the initial estimate of "time-remaining" in light of any adjustments made to the initial estimated time for performing the cycle.

13. The method of claim 12 wherein the appliance comprises a washing machine and the at least one operational mode is selected from the group comprising fill and drain modes of the washing machine.

14. The method of claim 13 wherein the at least one appliance parameter is selected from the group consisting of actual completion times, estimates of flow rate, and estimates of water pressure.

15. The method of claim 12 wherein the computing of the time estimate for the at least one operational mode comprises computing a running average on the historical data corresponding to the selected option for the present cycle.

16. The method of claim 15 wherein the running average comprises an exponentially weighted moving average.

17. The method of claim 12 further comprising displaying an estimated value of "time-remaining" for completing the present cycle as the appliance progresses through the cycle, the displayed value of "time-remaining" being decremented by a sequence of steps of equal size from an initial estimate of "time-remaining" based on the initial estimate for performing the present cycle.

18. The method of claim 12 wherein in the event the value of the updated estimate of "time-remaining" substantially corresponds to the value of "time-remaining" being displayed, the sequence of equal size steps for decrementing the displayed value is triggered at time intervals corresponding to the size of each decrementing step.

19. The method of claim 12 wherein in the event the value of the updated estimate of "time-remaining" deviates from the value of "time-remaining" being displayed, the sequence of equal size steps for decrementing the displayed value is triggered at time intervals that vary relative to the size of each decrementing step, the time interval variation based on a functional relationship between the value of the updated estimate of "time-remaining" and the displayed value for "time-remaining".

20. The method of claim 19 wherein the functional relationship is based on the ratio of the value of the updated estimate of "time-remaining" over the displayed value for "time-remaining".

21. The method of claim 20 further comprising adjusting the estimate of "time-remaining" in light of any changes made by the user to any previously selected option for the present cycle.

22. A method for estimating the time required to perform an operational cycle of an appliance, the cycle including at least one operational mode whose individual duration varies depending on the time it takes the appliance to reach a desired condition, the method comprising:

determining the actual time used for performing at least one occurrence of the operational mode during the present cycle;

relating the actual time used for performing the at least one occurrence of the operational mode during the present cycle relative to the time estimate used for computing an initial estimated time for performing the present cycle of the appliance;

adjusting the initial estimated time for performing the present cycle of the appliance in light of any differences between the actual and estimated times for the at least one operational mode; and displaying an estimated value of "time-remaining" for completing the present cycle as the appliance progresses through the cycle, the displayed value of "time-remaining" being decremented by a sequence of steps of equal size from the initial estimate of "time-remaining" based on the initial estimate for performing the present cycle.

23. The method of claim 22 further comprising updating the initial estimate of "time-remaining" in light of any adjustments made to the initial estimated time for performing the cycle.

24. The method of claim 23 wherein in the event the value of the updated estimate of "time-remaining" substantially corresponds to the value of "time-remaining" being displayed, the sequence of equal size steps for decrementing the displayed value is triggered at time intervals corresponding to the size of each decrementing step.

25. The method of claim 23 wherein in the event the value of the updated estimate of "time-remaining" deviates from the value of "time-remaining" being displayed, the sequence of equal size steps for decrementing the displayed value is triggered at time intervals that vary relative to the size of each decrementing step, the time interval variation based on a functional relationship between the value of the updated estimate of "time-remaining" and the displayed value for "time-remaining".

26. The method of claim 25 wherein the functional relationship is based on the ratio of the value of the updated estimate of "time-remaining" over the displayed value for "time-remaining".

27. The method of claim 26 further comprising adjusting the estimate of "time-remaining" in light of any changes made by the user to any previously selected option for the present cycle.

28. The method of claim 22 wherein the appliance comprises a washing machine and the at least one operational mode is selected from the group comprising fill and drain modes of the washing machine.

29. The method of claim 22 wherein the computing of the time estimate for the at least one operational mode comprises computing a running average on to historical data corresponding to the selected option for the present cycle.

30. The method of claim 29 wherein the running average comprises an exponentially weighted moving average.

* * * * *

UNITED STATES PATENT AND TRADEMARK OFFICE

CERTIFICATE OF CORRECTION

PATENT NO. : 6,718,587 B2
APPLICATION NO. : 09/681981
DATED : April 13, 2004
INVENTOR(S) : Hayes et al.

It is certified that error appears in the above-identified patent and that said Letters Patent is hereby corrected as shown below:

In the Claims

Col. 9, Claim 8, lines 10-11 after "the value of the updated estimate of" delete "and the "time-remaining"" and insert therefor -- "time-remaining" and the --.

Signed and Sealed this
Twenty-ninth Day of July, 2014

Michelle K. Lee

Michelle K. Lee
*Deputy Director of the United States Patent and Trademark Office*